US005570875A

United States Patent [19]

Jung

[11] Patent Number: 5,570,875

[45] Date of Patent: Nov. 5, 1996

[54] SHEET ALIGNMENT DEVICE WITH FLEXIBLE PUSH ROD

[75] Inventor: Yeon K. Jung, Seoul, Rep. of Korea

[73] Assignee: Sindo Richo Co., Ltd., Seoul, Rep. of Korea

[21] Appl. No.: 465,218

[22] Filed: Jun. 5, 1995

[30] Foreign Application Priority Data

Aug. 30, 1994 [KR] Rep. of Korea ..... 94-21651

[51] Int. Cl.[6] ..... B65H 31/36

[52] U.S. Cl. ..... 270/58.09; 271/221; 270/58.08; 270/58.12

[58] Field of Search ..... 270/58.12, 58.13, 270/58.16, 58.17, 58.27; 271/220, 221

[56] References Cited

U.S. PATENT DOCUMENTS

| | | | |
|---|---|---|---|
| 4,084,809 | 4/1978 | Looney | 271/220 |
| 4,248,413 | 2/1981 | Fox | 270/58.17 |
| 4,844,440 | 7/1989 | Gray | 271/221 X |
| 4,883,265 | 11/1989 | Iida et al. | 271/220 |
| 5,044,625 | 9/1991 | Reid | 270/58.16 X |
| 5,090,673 | 2/1992 | Kitahara et al. . | |
| 5,288,062 | 2/1994 | Rizzolo et al. | 271/220 X |

FOREIGN PATENT DOCUMENTS

| | | | |
|---|---|---|---|
| 4116991 | 11/1992 | Germany | 271/220 |
| 62-46863 | 2/1987 | Japan | 271/220 |

*Primary Examiner*—John E. Ryznic
*Attorney, Agent, or Firm*—Keck, Mahin & Cate

[57] ABSTRACT

The present invention relates to a sheet post treatment apparatus aligning, within certain limits, discharged sheets received in said bin tray and drastically reduces the driving load of the motor, operating space and manufacturing costs through keeping the length of the aligning rod as short as possible for transferring sheets. The apparatus comprises a driving gear connected to a power driving motor and output gear engaged with said driving gear; transfer shaft equipped at one side of said bin tray; feed roller attached to said transfer shaft and comprised of multiple projections around the circumference thereof; flexible push rod contacted to said feed roller and formed with multiple guide holes at the central part thereof; receiving housing installed between said side plate and transfer shaft and formed with a receiving groove; aligning rod positioned in the slot part of said bin tray and one end part of said flexible push rod is inserted and fixed at one side thereof; and a light sensor for controlling the level of moving displacement of said flexible push rod.

2 Claims, 6 Drawing Sheets

SHEET ALIGNMENT DEVICE WITH FLEXIBLE PUSH ROD

BACKGROUND OF THE INVENTION

The present invention relates to a sheet post treatment apparatus, and more particularly to a sheet post treatment apparatus applied to a stapler sorter attached to the sheet discharge part of an office machinery, like a copying machine or facsimile, and comprising multiple bin trays, which through ascending or descending operations at regular intervals, successively separate and carry sheets discharged from said sheet discharge part by or in the order of pages and moving and aligning sheets received in said bin tray for stapling within certain limits.

Recently, various convenient functions are provided by office machinery due to the influence of the automation of the office work environment. A sorter needs a stapling function after sorting and several sheet post treatment apparatuses have been proposed to move and align sheets received in bin trays to a site available for stapling.

A traditional sheet post treatment apparatus like the one proposed in the U.S. Pat. No. 5,090,673 is briefly explained in the following, using FIGS. 1 and 2.

FIG. 1 is a perspective view which roughly shows one embodiment of a traditional sheet post treatment apparatus and FIG. 2 is a top plan view which shows the operation of the traditional sheet post treatment apparatus.

In FIGS. 1 and 2, the numbered parts are the following: 101 a bin unit housing, 101*a* a vertical frame, 101*b* a lower frame, 102 a bin cover, 103 a bin slot, 104 a bin roller, 105 a bin tray, 106 a slot, 107 an upper arm, 108 a lower arm, 109 a rotation center shaft, 110 a sector gear, 111 an aligning rod, 112 an aligning rod driving motor, 113 an output gear, 114 an alignment reference plate, and 115 a stapler.

As shown in FIGS. 1 and 2, when a sheet discharge part discharges sheets, a sheet post treatment apparatus applied to a stapler sorter moves and aligns the sheets to a site available for stapling.

To said sheet discharge part are attached the bin unit housing 101 consisting of the vertical frame 101*a* and the lower frame 101*b* and the designated bin cover 102 where two side ends are supported by vertical frames 101*a*.

The bin tray 105 is equipped with two bin rollers 104 which moves up and down along bin slots 103 formed in rear vertical frames 101*a'* of said bin unit housing 101 and the fan-shaped slot 106 of designated size is formed in a designated site of said bin tray 105. To one side of the bin cover 102 and the lower frame 101*b* are attached two ends of the rotation center shaft 109 which forms one unit with the upper arm 107 and the lower arm 108, and the circular arc-shaped sector gear 110 is equipped in the lower end of the lower arm 108 of said movement center shaft 109. The aligning rod 111 is connected to the upper arm 107 and the lower arm 108 of said rotation center shaft 109 and equipped to be inserted in the slot 106 of said bin tray 105. The aligning rod 111 is rotated to move and align sheets discharged from the sheet discharge part to one side of the bin tray 105 for stapling by the stapler 115.

The aligning driving motor 112 is equipped in the designated lower end part of said bin unit housing 101 and impressed and driven by an external power supply. The output gear 113, equipped in the shaft of the aligning rod driving motor 112, transmits driving power engaged with a sector gear 110.

The alignment reference plate 114, in FIG. 2, is equipped at one side of bin tray 105 and helps in the alignment of one side of the sheets moved to the stapling site of said stapler 115.

The forementioned traditional sheet post treatment apparatus moves and aligns sheets discharged from the sheet discharge part and received in a bin tray at the stapling site of the stapler by the aligning rod 111 rotated by the driving power of the aligning rod driving motor 112.

The forementioned traditional sheet post treatment apparatus requires additional space for the aligning rod hanged up on from the upper end to the lower end of multiple bin trays and thus results in a problem of having big machinery size to that extent. In particular, small size machinery having sheet sizes of two varieties or less have less efficiency regarding increased costs and additional space and a problem in that it is impossible to align sheets having sizes beyond the coverage of the rotation capacity of the aligning rod.

To overcome the aforementioned problems, according to U.S. Pat. No. 5,054,766 as shown in FIG. 3, a sheet post treatment apparatus moving aligning rod by belt was proposed. The straight line-shaped slot 207 of a designated size is formed at one side of said bin tray 201 and the aligning rod 203 is moved through said slot 207. Said aligning rod 203 is fixed at designated sites of belts 205 connected to pulleys 204 equipped at the upper and lower ends of said bin tray 201 and moved to align discharged sheets. This structure allows the aligning of discharged sheets of small sizes but it needs to have additional equipment to move said aligning rod 203, thus resulting in a complex structure of the sorter and increased manufacturing costs.

The forementioned sheet post treatment apparatus has aligning rods through bin trays piled on one another from the upper part to the lower part and thus has on increased driving load and it needs additional space for the aligning rods, resulting in a complex and bigger structure of a sorter.

SUMMARY OF THE INVENTION

It is therefore an object of the present invention to eliminate the aforementioned problems by providing a sheet post treatment apparatus which sufficiently does the aligning function by aligning discharged sheets only in the receiving area for discharged sheets, considering the fact that bin trays are always positioned around the site of sheet discharge rollers to receive discharged sheets and always pass by the receiving area for discharged sheets while moving up or down.

In order to attain the foregoing objects, the present invention provides a sheet post treatment apparatus for stapling applied to a stapler sorter positioned at both enacts of the sheet discharge part of a copying machine and equipped with side plates formed with slot liners of a designated size for successively receiving and carrying discharged sheets by or in the order of pages and equipped with multiple bin trays attached to said sheet discharge part piled on one another and formed with slots of a designated size at one side thereof for providing a moving path of an aligning operation and equipped with a driving motor installed in the lower end of a side of said bin tray and impressed and regularly rotated by an external driving power source, comprising: a power transmitting means, attached to said driving motor, for transmitting driving power; a transfer shaft vertically equipped at one side of said bin tray and driven by said power transmitting means; one or more feed rollers attached to a designated site of said transfer shaft and equipped with multiple projections of a designated size at regular intervals around the circumference thereof; one or more flexible push rods composed of bendable elastic material and, bent at a designated angle, contacted to said feed roller and formed with multiple guide holes at regular intervals in the central part thereof and moved by said projections of the feed roller inserted into and pulled out from the guide holes; a receiving housing installed between said side plate and said transfer shaft and formed with a receiving groove of a designated size for receiving the length change due to the retreat of said flexible push rod; an aligning means of a designated length, the length thereof is kept as short as possible for a designated area of a sheet discharge site, positioned at the slot part of said bin tray and one end part of said flexible push rod in inserted end fixed at one side thereof, and for moving and aligning the received sheets in said bin tray at a site available for stapling through rectilinear movement; and a light sensor attached at a designated site of a moving path of said flexible push rod and for controlling the level of moving displacement by passing light through the guide holes formed at the central part of the flexible push rod and counting the number of guide holes.

BRIEF DESCRIPTION OF THE DIAGRAMS

The above and other objects, features and advantages of the present invention will be clearly understood from the following detailed description taken in conjunction with the accompanying diagrams, in which.

DETAILED DESCRIPTION OF THE PREFERRED EMBODIMENTS

Figure 1:
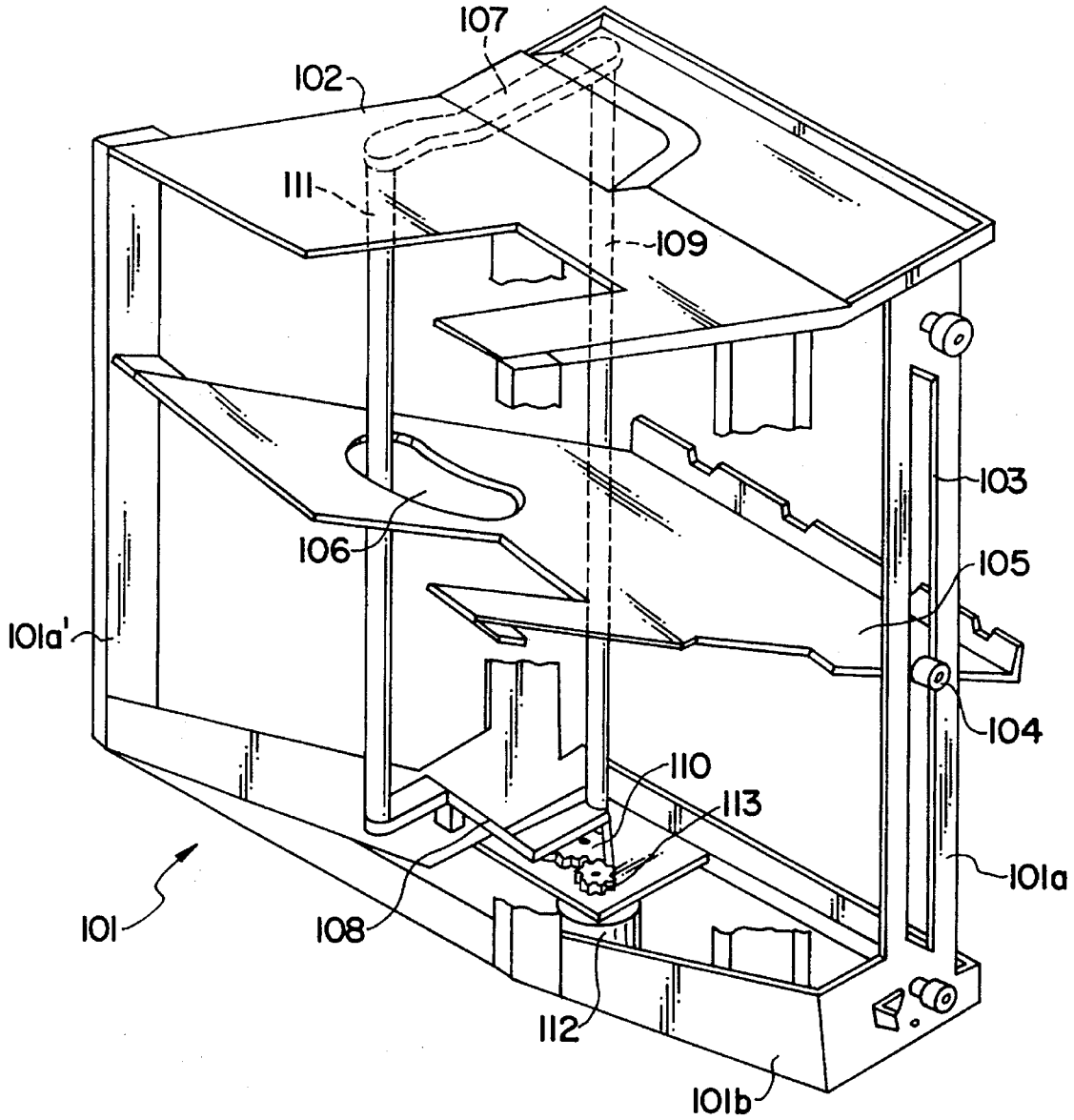
FIG. 1 (PRIOR ART)
FIG. 1 is a perspective view roughly showing the structure of one embodiment according to a traditional sheet post treatment apparatus.
Figure 2:
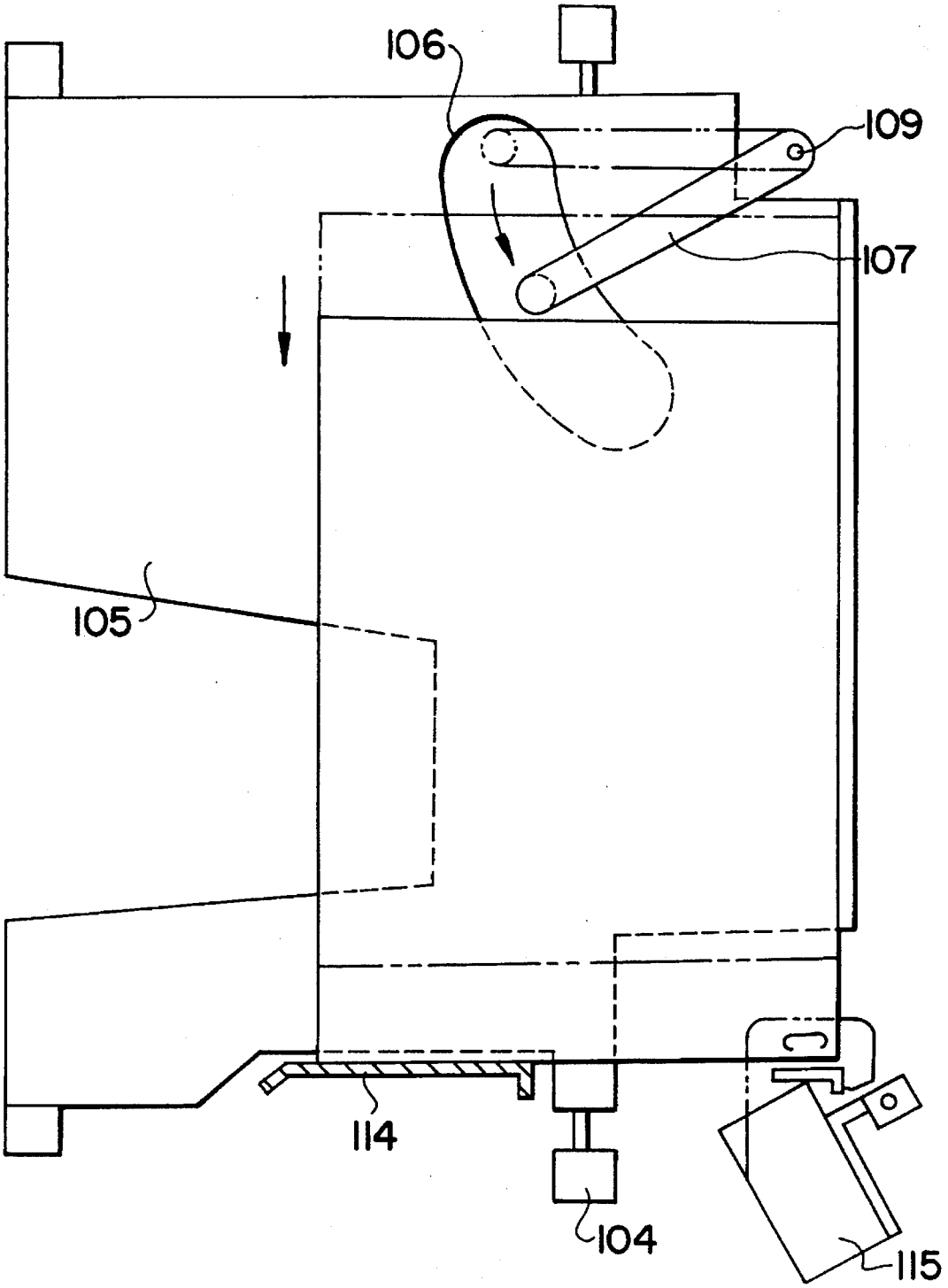
FIG. 2 (PRIOR ART)
FIG. 2 is a top plan view showing the operating situation according to a traditional sheet post treatment apparatus.
Figure 3:
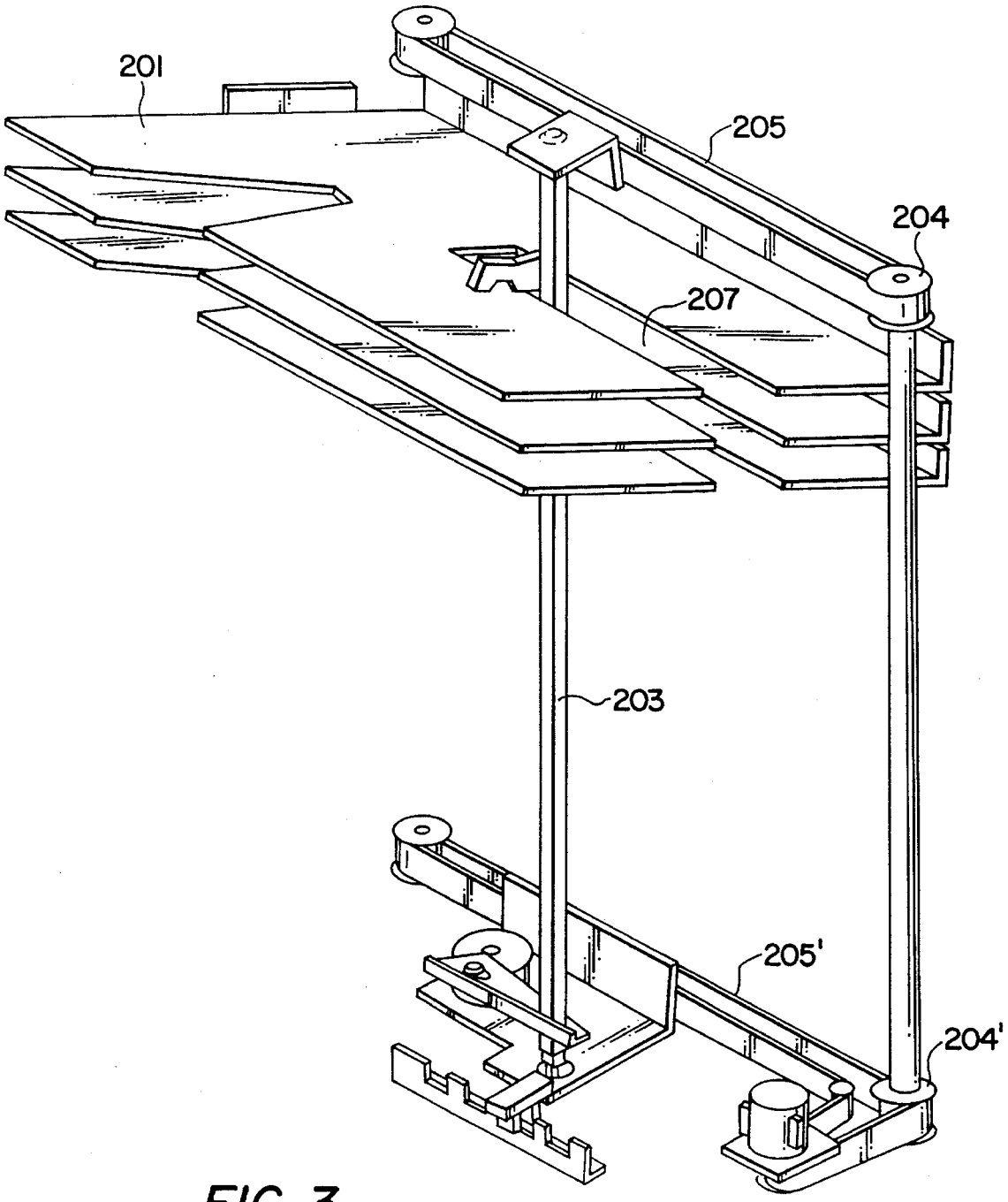
FIG. 3 (PRIOR ART)
FIG. 3 is a perspective view roughly showing the structure of another embodiment according to a traditional sheet post treatment apparatus.
Figure 4:
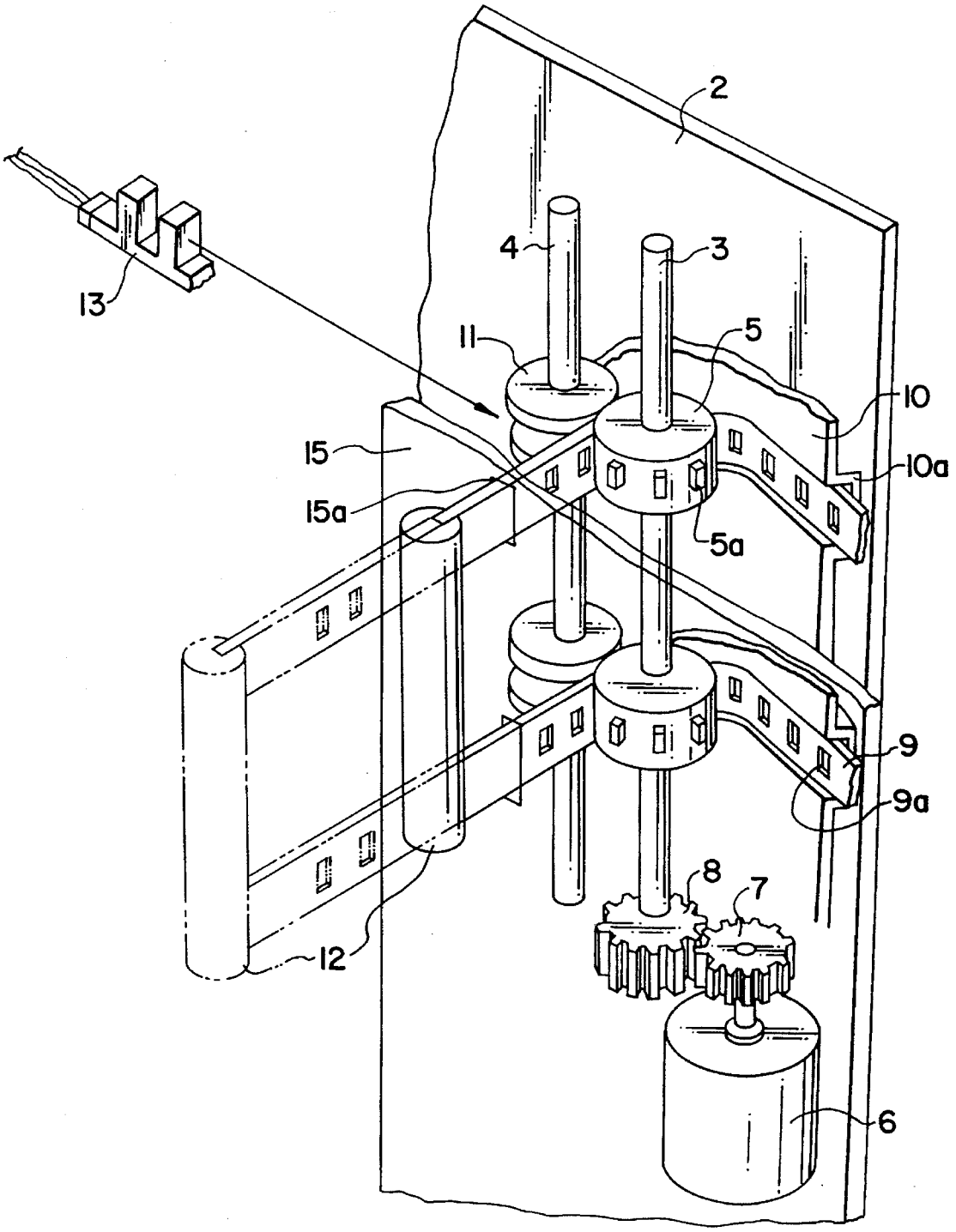
FIG. 4 is a perspective view showing the structure of one embodiment the sheet post treatment apparatus according to the present invention.
Figure 5:
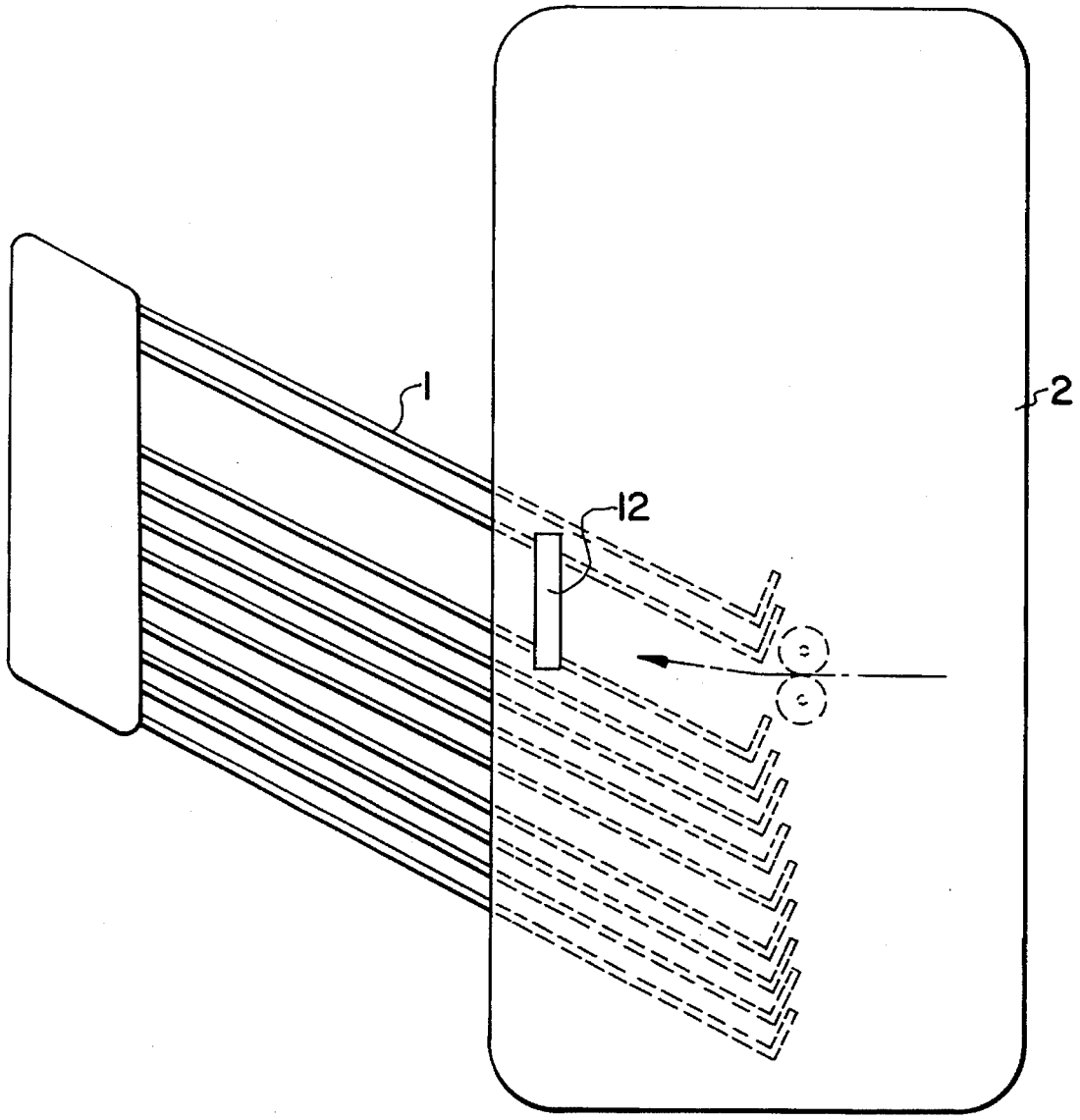
FIG. 5 is an outline view showing a side of the sheet post treatment apparatus according to the present invention.
Figure 6:
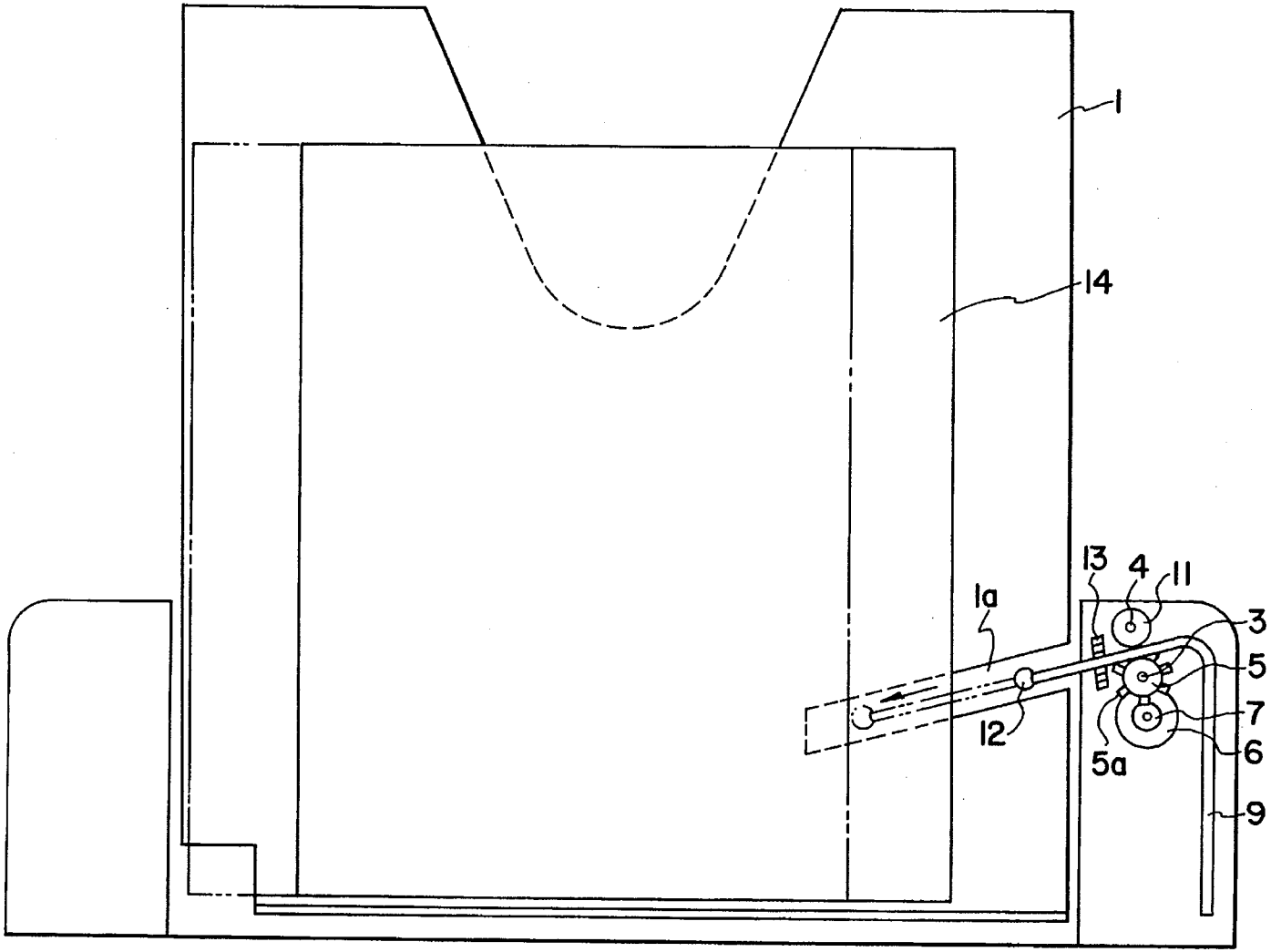
FIG. 6 is an operating situation view of the sheet post treatment apparatus according to the present invention.

Referring to FIGS. 4, 5 and 6, one embodiment of the present invention is described in detail in the following.

FIG. 4 is a perspective view showing the structure of one embodiment of the sheet post treatment apparatus according to the present invention and FIG. 5 is an outline view showing the side of the sheet post treatment apparatus according to the present invention, and FIG. 6 is an operation situation view of the sheet post treatment apparatus according to the present invention.

In FIGS. 4 to 6, the numbered parts are the following: 1 a bin tray, 1*a* a slot part, 2 a side plate, 3 a transfer shaft, 4 a driving shaft, 5 a feed roller, 5*a* a projection, 6 a driving motor, 7 a driving gear, 8 an output gear, 9 a flexible push rod, 9*a* a guide hole, 10 a receiving housing, 10*a* a receiving groove, 11 a supporting roller, 12 an aligning rod, 13 a light sensor, 14 a copying sheet, 15 a bin tray supporting frame, and 15*a* a hole.

As shown in FIGS. 4 to 6, the sheet post treatment apparatus of a sorter, according to the present invention, implements small size and light-weight uses by minimizing the driving load and driving space. The structure thereof is explained in detail in the following:

Multiple bin trays 1 formed with straight line-shaped slot parts 1*a* of a designated size at sides thereof for providing moving paths of aligning operation and are attached and piled on one another in the sheet discharge part of a copying machine and successively receive and carry the discharged sheets by or in the order of pages.

Transfer shaft 3 and driving shaft 4 are installed vertically parallel between one side of the side plate 2, equipped at both ends of the sheet discharge part of a copying machine and a bin tray supporting frame, and feed rollers 5 are respectively attached to the designated sites of the upper part and the lower part of said transfer shaft 3 and multiple projections 5*a* of a designated size are equipped at regular intervals at the center of the circumference of a feed roller.

The driving motor 6 is installed at one side of the lower end part of said transfer shaft 3 and impressed and driven by an external driving power, and driving gear 7 is attached to the shaft of said driving motor 6 and said driving gear 7 is engaged with the output gear 8, equipped at the lower end part of said transfer shaft 3, and transmits regular and reverse rotation power of driving motor 6 to said feed roller 5.

Flexible push rod 9 of a designated size and cross-sectional shape is gently rounded out and made up of elastic, springy material and bent at a designated angle and attached to the circumference side of said feed roller 5 and moves forward or backward and, at the central part of said flexible push rod 9, multiple guide holes 9*a* of designated sizes are formed at regular intervals, corresponding to projections 5*a* of said feed roller 5, and control the level of moving displacement of said push rod 9.

Said flexible push rod 9 is moved by projections 5*a* of said feed roller 5 inserted into and pulled out from the guide holes 9*a* thereof, and thus enables exact position controlling without slipping or twisting, according to the various sheet sizes.

One side of said flexible push rod 9 is inserted into hole 15*a* formed in said bin tray supporting frame and the other side thereof is positioned between said feed roller 5 and side plate 2. Receiving groove 10*a* formed in the receiving housing 10, which is gently bent, receives the length change according to the retreat of the flexible push rod and thus enables said flexible push rod to function like a rigid body during forward movement, without bending, and to move smoothly at a right angle by being contacted to the curved surface of said receiving housing 10 and bent during backward movement.

Two supporting rollers 11 are equipped at the designated sites of said driving shaft 4 corresponding to the sites of two feed rollers 5 and contacted to the upper and lower sides (excluding guide holes 9*a*) of said flexible push rod 9 and support the flexible push rod, thus preventing the guide hole 9*a* of the flexible push rod 9 from being pulled out from projections 5*a* of said feed roller 5.

Aligning rod 12 of designated length is attached to one end of each flexible push rod 9 and passes through hole 15*a* of said bin tray supporting frame 15 and said aligning rod 12 is inserted into slot part 1*a* of bin tray 1 and moves discharged sheets to a site available for stapling through rectilinear movement. The length of said aligning rod 12, considering the fact that bin tray 1 is always positioned in the region of the sheet discharge roller to receive discharged sheets at the moment of sheet receiving, is determined in proportion to the designated area covering only the upward and downward movements of said bin tray 1, thus minimizing the load according to the drive.

Light sensor 13 is equipped at a designated site of the moving path of said rectilinearly moving flexible push rod 9 and said light sensor 13 controls the stopping site of said aligning rod 12 by passing light through guide holes 9*a* of said flexible push rod 9 and senses the level of moving displacement through the counting of the number of said guide holes 9*a*.

Referring to FIGS. 5 and 6, the operation of the present invention structured as mentioned above described in is the following:

After copying sheets 14, discharged from the sheet discharge part of a copying machine, are received in bin tray 1 by or in the order of pages, driving motor 6 is impressed by an external driving power and is regularly rotated and the driving power thereof rotates driving gear 7 and output gear 8 and then transfer shaft 3. As said transfer shaft 3 reversely rotates, feed rollers 5, respectively equipped at designated sites of the upper and lower parts of the transfer shaft, reversely rotate and moves forward flexible push rod 9 contracted at a right angle to the circumference thereof and standing by in receiving groove 10*a* of said receiving housing 10 towards bin tray 1. Said flexible push rod 9 is moved by projections 5*a* of the feed roller inserted into and pulled out from guide hole 9*a* thereof and implements exact drive without slipping or twisting. As said flexible push rod 9 moves forward, light sensor 13 transmits light through guide hole 9*a* of the flexible push rod and senses the level of moving displacement, then aligns rod 12, positioned at one side of slot part 1*a* of said bin tray 1, and follows the control signal from the central control unit, where the size of the sheet is established, and drives forward in accordance with the sheet size and moves and aligns copying sheets 14 received at the site available for stapling.

The present invention structured and operated as mentioned above drastically reduces the driving lead of the motor, operating space and manufacturing costs by keeping the length of the aligning rod as short as possible for transferring sheets.

Although the preferred embodiments of the present invention have been disclosed for illustrative purposed, those skilled in the art will appreciate that various modifications, additions and substitutions are possible, without departing from the scope and spirit of the invention as disclosed in the accompanying claims.

What is claimed is:

1. A sheet post treatment apparatus for stapling, applied to a stapler sorter positioned at both ends of a sheet discharge part of a copying machine and equipped with side plates formed with slot liners of a designated size for successively receiving and carrying discharged sheets by or in the order of pages, and equipped with multiple bin trays attached to said sheet discharge part piled on one another and formed with slots of a designated size at one side thereof for providing a moving path of an aligning operation and equipped with a driving motor installed in the lower end of a side of said bin tray and impressed and regularly rotated by an external driving power source, comprising:

a power transmitting means, attached to said driving motor, for transmitting driving power;

a transfer shaft vertically equipped at one side of said bin tray and driven by said power transmitting means;

one or more feed rollers attached to a designated site of said transfer shaft and equipped with multiple projections of a designated size at regular intervals around a circumference thereof;

one or more flexible push rods composed of bendable elastic material and, bent at a designated angle, contacted to said feed roller and formed with multiple guide holes at regular intervals in a central part thereof and moved by the projections of said feed roller inserted into and pulled out from the guide holes;

a receiving housing installed between said side plate and said transfer shaft and formed with a receiving groove of a designated size for receiving length change due to retreat of said flexible push rod;

an aligning means of a designated length, the length thereof is kept as short as possible for a designated area of a sheet discharge site, positioned at the slot part of said bin tray where one end part of said flexible push rod is inserted and fixed at one side thereof for moving and aligning the received sheets in said bin tray at a site available for stapling through rectilinear movement; and a light sensor attached at a designated site of a moving path of said flexible push rod, for controlling the level of moving displacement by passing light through the guide holes formed at the central part of the flexible push rod and counting the number of guide holes.

2. A sheet post treatment apparatus according to claim 1, further comprising:

one or more supporting rollers equipped corresponding to the sites of said one or more feed rollers and contacted to upper and lower sides, excluding a portion formed the guide holes, of said flexible push rods; and a driving shaft for fixing positions of said supporting rollers.

* * * * *